United States Patent [19]

Sluyterman et al.

[11] Patent Number: 4,492,943

[45] Date of Patent: Jan. 8, 1985

[54] DEVICE FOR DISPLAYING TELEVISION PICTURES AND DEFLECTION UNIT THEREFOR

[75] Inventors: Albertus A. S. Sluyterman; Nicolaas G. Vink, both of Eindhoven, Netherlands

[73] Assignee: U.S. Philips Corporation, New York, N.Y.

[21] Appl. No.: 583,069

[22] Filed: Feb. 23, 1984

[30] Foreign Application Priority Data

Feb. 28, 1983 [NL] Netherlands ..... 8300729

[51] Int. Cl.[3] ..... H01F 5/02

[52] U.S. Cl. ..... 335/213; 335/210

[58] Field of Search ..... 335/210, 213; 313/421, 313/426, 428

[56] References Cited

U.S. PATENT DOCUMENTS

| | | | |
|---|---|---|---|
| 4,096,462 | 6/1978 | Akatsu et al. | 335/210 X |
| 4,122,422 | 10/1978 | Hasegawa et al. | 335/210 X |
| 4,229,720 | 10/1980 | Heijnemans et al. | 335/210 X |
| 4,257,024 | 3/1981 | Shimoma et al. | 335/213 |
| 4,409,578 | 10/1983 | Beelaard et al. | 335/210 |

*Primary Examiner*—George Harris

*Attorney, Agent, or Firm*—Thomas A. Briody; William J. Streeter; Marianne Rich

[57] ABSTRACT

An electromagnetic deflection unit is disposed around a portion of a display tube and comprises a first deflection coil for producing, when energized, a frame deflection field and a second deflection coil for producing, when energized, a line deflection field the second deflection coil and being located coaxially within the first deflection coil, each deflection coil having two diametrically oppositely located deflection coil units. The first deflection coil has a winding distribution for generating, upon energization, a dipole deflection field in combination with a positive sixpole deflection field on the side of the gun system, generating a dipole field in combination with a negative sixpole field in the central area, and generating a dipole field in combination with a positive sixpole on the side facing the display screen, the first and the second deflection coils being positioned axially with respect to each other in such manner that upon energization the magnetic field generated by the first deflection coil extends further towards the display screen than the magnetic field generated by the second deflection coil so that the device shows a minimum east-west raster error.

3 Claims, 13 Drawing Figures

DEVICE FOR DISPLAYING TELEVISION PICTURES AND DEFLECTION UNIT THEREFOR

BACKGROUND OF THE INVENTION

1. Field of the Invention

The invention relates to a device for displaying television pictures by means of a display tube in the neck of which an electron gun system is present for emitting at least one electron beam towards a display screen and having an electromagnetic deflection unit which is disposed around a portion of the display tube and which comprises a first deflection coil for producing, when energized, a frame deflection field and a second deflection coil for producing, when energized, a line deflection field, said second deflection coil being located coaxially within the first deflection coil, each deflection coil having two diametrically oppositely located coil units the first deflection coil (the frame deflection coil) having a winding distribution for producing, upon energization, a dipole field in combination with a positive sixpole field on the side of the gun system, producing a dipole field in combination with a negative sixpole field in the central area, and producing a dipole field in combination with a positive sixpole field on the side facing the display screen.

2. Description of the Prior Art

In monochrome display tubes the electron gun system is designed to produce one electron beam. In colour display tubes the electron gun system is designed to produce three electron beams.

For some time now colour display tubes have been used in which three electron beams which are spatially separated from each other are located in one plane. Such a display tube is known as an in-line colour display tube. In the in-line colour display tube it is endeavoured to use a deflection unit having deflection coils which give such an inhomogeneous field distribution that the beams of the electron guns coincide over the whole screen when being deflected. For that purpose in particular the line deflection field (to be generated by the second deflection coil) on the gun side of the deflection yoke must be barrel-shaped and towards the screen side it must be pincushion-shaped, and, conversely, the frame deflection field (to be generated by the first deflection coil) must be pincushion-shaped on the gun side and it must be barrel-shaped more towards the screen side.

The extent of pincushion shape and barrel shape is such that upon deflection the convergence errors of the electron beams emitted by the electron guns are corrected as a result of which pictures of satisfactory convergence properties can be produced on the screen of the display tube. Display tube-deflection yoke combinations of this type are said to be self-converging.

Although the convergence is ensured in this manner (for that purpose, in practice, the deflection coils must often be combined with auxiliary means for intensifying the pincushion shape and barrel shape of the deflection field, which auxiliary means are, for example, plates of soft-magnetic, metallic material placed in the deflection fields), a certain raster distortion (east-west raster distortion) often proves to occur still on the vertical sides of the display screen which has to be corrected.

Such a design of the first deflection coil (that is the coil for deflecting the electron beams in the vertical direction or frame deflection coil) that upon energisation it produces, on its side facing the gun system, a dipole field in combination with a positive sixpole field (resulting in a pincushion shaped deflection field), produces a dipole field in its central area in combination with a negative sixpole field (resulting in a barrel shaped deflection field), and produces a dipole field on its side facing the display screen in combination with a positive sixpole field (resulting in a pincushion shaped deflection field), may lead to a TV display device which satisfies the requirements imposed as regards self-convergence and raster distortion. However, with the winding methods used nowadays it is very difficult, if not impossible, to produce as a production item a frame deflection coil which has such a strongly varying winding distribution as is necessary to realise the above-described deflection field design. This applies in particular with reference to the winding distribution on the screen side. In order to make the pincushion shape of the frame deflection field on the screen side so pronounced as is necessary for achieving a minimum east-west raster distortion, it is required to make the sixpole component sufficiently positive. The sixpole component becomes more positive as the window aperture, which in saddle coils is defined as the angular aperture between the two axially extending winding segments, becomes larger. However, the strength of the sixpole cannot be made unrestrictedly large. With an angular aperture of 180° the maximum strength is reached. When the angular aperture is made larger than 180°, for which purpose the coil units of the saddle coils would have to overlap each other, the strength of the sixpole component decreases. Moreover, the more pronounced the pincushion shape is made on the screen side, the more pronounced must be the barrel shape in the central area to keep the astigmatism error to a minimum and this means that the pincushion shape on the gun side must be proportionally more pronounced to keep the coma error to a minimum. This means that it becomes more and more difficult to manufacture the frame deflection coil. So for practical reasons it would be desirable to have a not too pronounced pincushion shape of the frame deflection field on the screen side. The invention provides a solution to this problem. For that purpose, the device of the kind described in the opening paragraph is characterized in that the first and the second deflection coils are positioned in the axial direction relative to each other in such manner that upon energisation the magnetic field generated by the first deflection coil extends so much farther towards the display screen than the magnetic field generated by the second deflection coil that the device shows a minimum east-west raster distortion.

Since the frame deflection field extends farther towards the screen than the line deflection field, not too strongly pronounced a pincushion shape of the frame deflection field in the screen side area will suffice while nevertheless the requirement of a minimum east-west raster error is satisfied and it is easier to wind the frame deflection coil in such manner that the requirements of minimum convergence errors (astigmatism and coma errors) are fulfilled.

The deflection units for television display devices having both a line deflection coil and a frame deflection coil of the saddle-type have so far been constructed so that the deflection field generated by the line deflection coil on the screen side extended farther than the deflection field generated by the frame deflection coil. The invention on the contrary uses the recognition that by causing the frame deflection field to extend farther to the screen side than the line deflection field, east-west raster errors can be minimised.

SUMMARY OF THE INVENTION

In one embodiment of the invention each of the coil units of the second deflection coil has two circumferentially spaced longitudinal segments which extend substantially in the direction of the longitudinal axis of the display tube and which are connected at their ends by transverse segments which extend in transverse directions with respect to said axis, the transverse segments facing the display screen being laid towards the display tube envelope for engaging relationship.

This construction in which the screen-sided transverse segments of the line coil units engage the envelope of the display tube permits (during the manufacture) the field coil to be moved over the line coil over such a distance in the direction of the display screen as is necessary to obtain a minimum east-west raster error.

The invention also relates to a deflection unit for use in a device as described hereinbefore.

An embodiment of the invention will be described in greater detail with reference to the drawing.

DETAILED DESCRIPTION OF THE PREFERRED EMBODIMENTS

Figures 1, 3A, 3B, 3C:
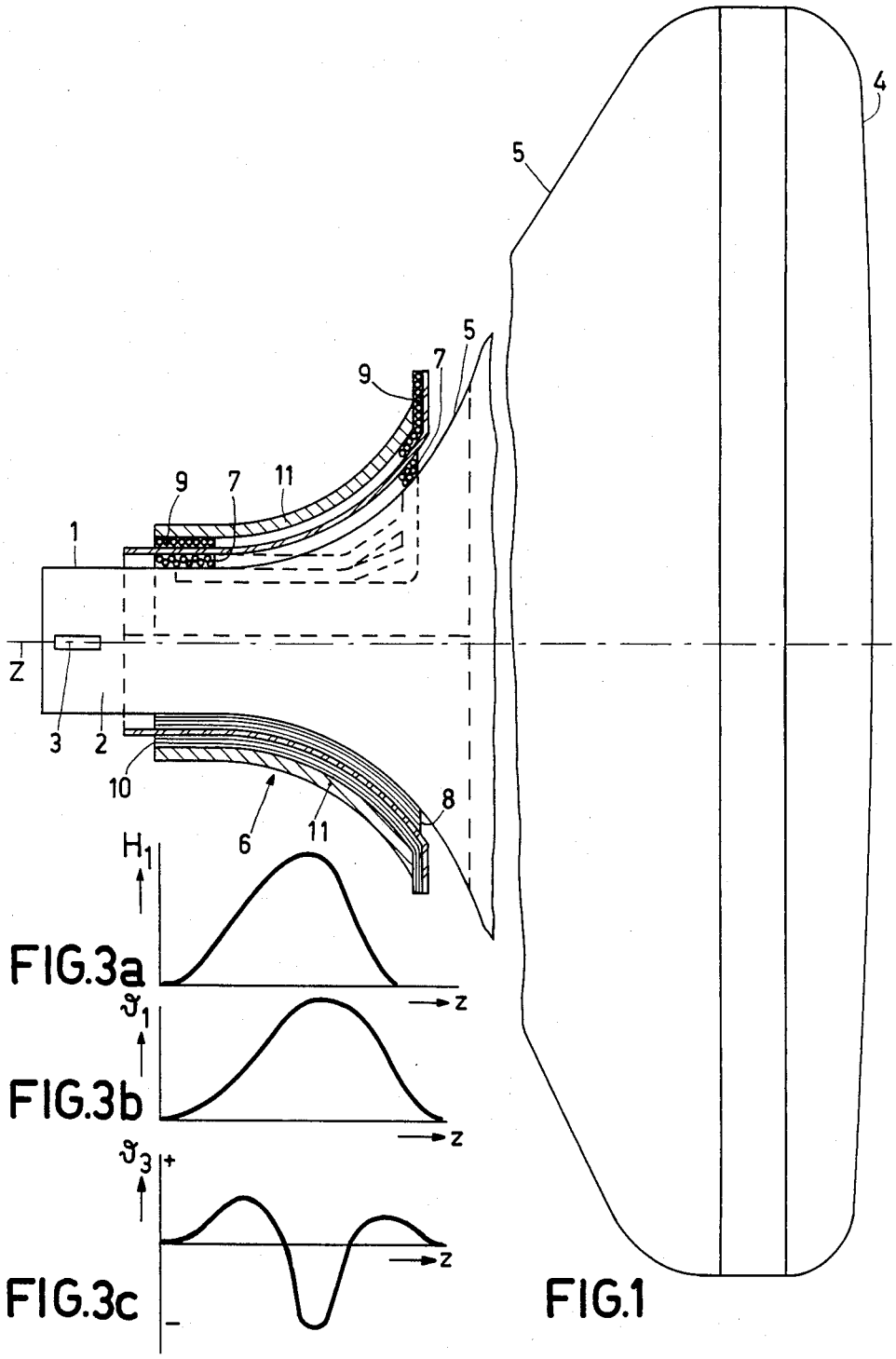
FIG. 1 is a diagrammatic cross-sectional view through a colour television display tube on which a deflection unit is mounted.
FIG. 3*a* shows a dipole field generated by the line coil of the deflection unit shown in FIG. 1.
FIG. 3*b* shows the dipole field generated by the field coil of the deflection unit of FIG. 1
FIG. 3*c* shows the sixpole field.

FIG. 1 shows a colour television display device having a display tube 1 of the three in-line beam type having a neck portion 2 in which an electron gun system 3 is placed to generate three electron beams situated in one plane and having a display screen 4 on which recurring groups of red, blue and green phosphor dots are provided in front of a (hole) mask.

A deflection unit 6 is provided around the envelope 5 of the display tube 1. It comprises a line deflection coil formed by two line deflection coil units 7, 8 around which a frame deflection coil is placed formed by two frame deflection coil units 9, 10. An annular core 11 of soft-magnetic material is placed coaxially around the line deflection coil and the frame deflection coil which in the figure are both coils of the saddle-type.

Figure 2:
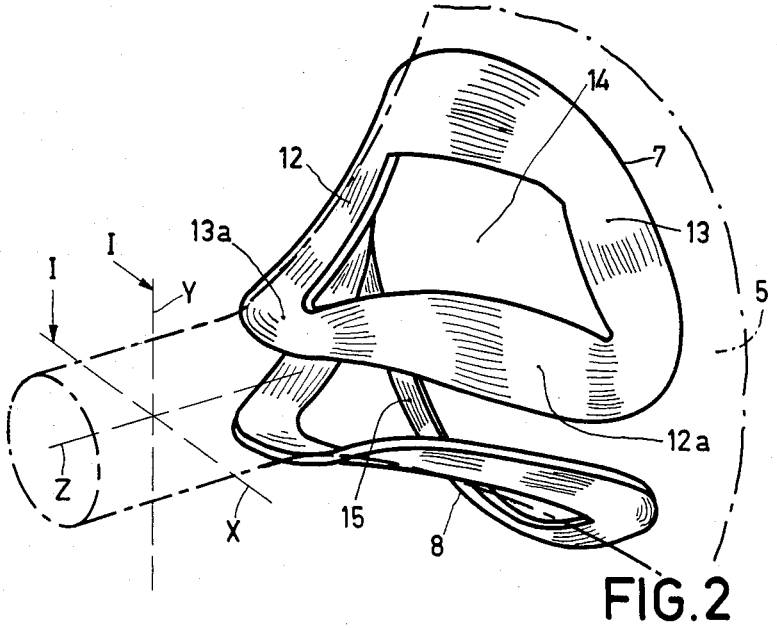
FIG. 2 is an elevation of the line coil of the deflection unit shown in FIG. 1.

The line deflection coil with the coil units 7, 8 is shown separately in FIG. 2. Coil unit 7 is formed by two longitudinal segments 12, 12*a*, extending in the axial direction and, together with transverse segments 13, 13*a*, define a window 14 (coil unit 8 is constructed identically). The (front) transverse segments 13, 15 of the coil units 7, 8 are shaped so as to engage the surface of the envelope 5 of the display tube as a result of which it is possible to position the frame deflection coil 9, 10 closer to the display screen 4 than the line deflection coil 7, 8.

The strength of the line dipole magnetic field which is generated along the z-axis by deflection unit 6 is denoted by $H_1$ in FIG. 3*a*, the strength of the frame dipole magnetic field is denoted by $V_1$ in FIG. 3*b* and the strength of the frame sixpole magnetic field in planes perpendicular to the z-axis is denoted by $V_3$ in FIG. 3*c*. In FIGS. 3*a*, 3*b*, and 3*c* the gun side of the deflection unit lies to the left and the screen side of this unit to the right. The frame deflection coil 9, 10 is designed so that upon energization a frame deflection field can be generated having a sixpole component which is very strongly negative in the central area of the deflection field (so that astigmatism errors are minimum), is strongly positive on the gun side (so that coma errors are minimum) and is sufficiently positive on the screen side to minimize east-west raster distortion. As will be seen by comparison of FIGS. 3*b* and 3*c* with FIG. 3*a* the frame deflection field extends farther towards the screen in the z-direction than the line deflection field. As a result of this the pincushion shape of the deflection field on an axial position where the line dipole field terminates, is strong enough to achieve a minimum east-west raster error, although the sixpole component at the screen side in itself is not so strongly positive.

Deflection fields having the characteristic shown in FIG. 3 may also be important for display devices using a monochrome display tube of high resolving power.

Referring back to FIGS. 1 and 2 it should be noted that in the case of a self-converging system of a display tube 1 having a deflection unit 6, the line deflection field to be generated by the line deflection coil unit 7, 8 should in known manner be pincushion-shaped on the side facing the display screen 4 and should be barrel shaped on the side facing the electron gun system 3.

The type of magnetic fields used hereinbefore will be explained with reference to FIGS. 4, 5 and 6.

Figure 4:
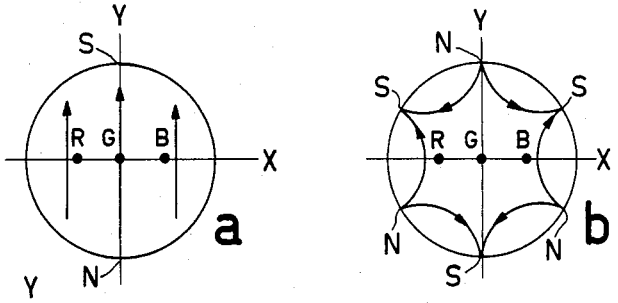
FIG. 4 is a cross-sectional view through a tube neck having shown therein diagrammatically a dipole line deflection field (a) and a positive sixpole line deflection field (b).

FIG. 4 is an elevation of a sectional view through a display tube at the position of its associated deflection unit, taken along a plane at right angles to the z-axis, viewed from the screen side. Electron beams generated in the display tube are denoted by R, G and B. The arrows in FIG. 4*a* represent the dipole line deflection field. In the case of the orientation of the line deflection field shown, deflection of the electron beams to the right will take place. So the three electron beams are situated in the same plane as the plane in which the deflection takes place. The arrows in FIG. 4*b* represent a sixpole field. The orientation of the sixpole field in FIG. 4*b* is such that the side beams R and B experience an extra deflection with respect to the central beam in the plane in which they are located. In such a case the sixpole field is defined as a positive sixpole (line deflection) field. A sixpole field having an orientation which causes the outer beams to experience a smaller deflection than the central beam in the plane in which they are situated, is defined as a negative sixpole (line deflection) field. When defining the sign of a sixpole frame deflection field reference should be made to the situation with a line deflection field.

Figure 5:
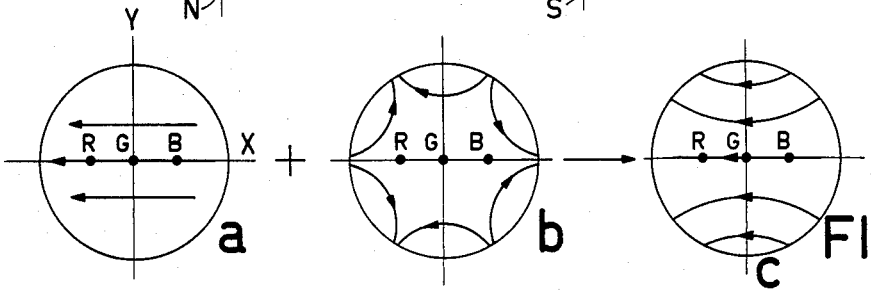
FIGS. 5*a*, *b* and *c* shows the effect of the combination of a positive frame dipole field with a positive sixpole field.

FIG. 5 is also an elevation of a sectional view through a display tube at the position of its associated deflection unit, taken along a plane at right angles to the z-axis, viewed from the screen side. In the case of the orientation of the dipole deflection field shown, deflection of the electron beams R, G and B upwards will take place. In this case the three electron beams are then situated in a plane at right angles to the plane in which the deflection takes place. The arrows in FIG. 5*b* represent a sixpole field. The orientation of the sixpole field in FIG. 5*b* is such that on the analogy of the comparable situation for a line deflection field (for this purpose FIGS. 5*a* and 5*b* are to be turned 90° to the right), this sixpole field is said to be positive. FIG. 5*c* shows the resulting frame deflection field which is pincushion shaped.

Figure 6:
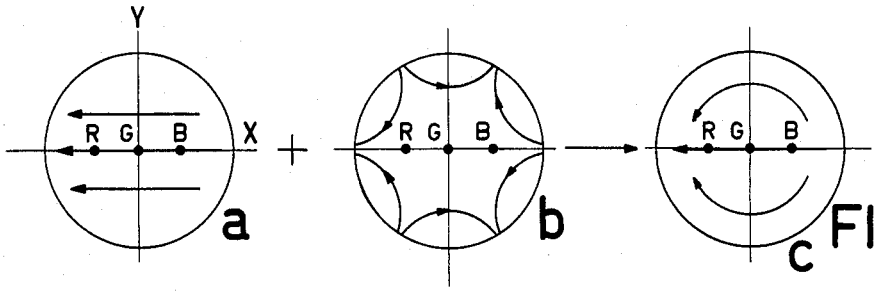
FIGS. 6*a*, *b* and *c* shows the effect of the combination of a positive frame dipole field with a negative sixpole field.

FIG. 6 is also an elevation of a sectional view through a display tube at the position of its associated deflection unit, taken along a plane at right angles to the z-axis, viewed from the screen side. The arrows in FIG. 6*a* represent the dipole frame deflection field. In the case of the orientation of the dipole deflection field shown, deflection of the electron beams R, G and B upwards will take place. The three electron beams are thus situated in a plane at right angles to the plane in which deflection takes place. The arrows in FIG. 6*b* represent a sixpole field. The orientation of the sixpole field in FIG. 6*b* is such that, on the analogy of the comparable situation for a line deflection field, said sixpole field is said to be negative. FIG. 6*c* shows the resulting frame deflection field which is barrel shaped.

What is claimed is:

1. In a device for displaying television pictures by means of a display tube in the neck of which a gun system is present for emitting at least one electron beam towards a display screen, and having an electromagnetic deflection unit which is disposed around a portion of the display tube and which comprises a first deflection coil for producing, when energized, a frame deflection field and a second deflection coil for producing when energized, a line deflection field, said second deflection coil being located coaxially within the first deflection coil, each deflection coil having two diametrically oppositely located coil units, the first deflection coil having a winding distribution for producing, upon energization, a dipole deflection field in combination with a positive sixpole deflection field on the side of the gun system, producing a dipole field in combination with a negative sixpole field in the central area, and producing a dipole field in combination with a positive sixpole field on the side facing the display screen, the improvement wherein the first and the second deflection coil are positioned in the axial direction relative to each other so that upon energisation the magnetic field generated by the first deflection coil extends farther towards the display screen than the magnetic field generated by the second deflection coil so that the device shows a minimum east-west raster distortion.

2. A device as claimed in claim 1, wherein the second deflection coil has two coil units of the saddle type.

3. A device as claimed in claim 2, wherein each of the coil units of the second deflection coil has two circumferentially spaced longitudinal segments which extend substantially in the direction of the longitudinal axis of the display tube and which are connected at their ends by transverse segments which extend in transverse directions with respect to said axis, the transverse segments facing the display screen being laid towards the display tube envelope for engaging relationship.

* * * * *